United States Patent [19]

Tarumi et al.

[11] 4,133,684

[45] Jan. 9, 1979

[54] ELECTROPHOTOGRAPHIC MATERIAL WITH INTERMEDIATE LAYER

[75] Inventors: Noriyoshi Tarumi, Tama; Akihiko Tamura; Masakazu Kokiso, both of Hachioji, all of Japan

[73] Assignee: Konishiroku Photo Industry Co., Ltd., Tokyo, Japan

[21] Appl. No.: 779,682

[22] Filed: Mar. 21, 1977

[30] Foreign Application Priority Data

Mar. 22, 1976 [JP] Japan ..... 51/29826
Apr. 6, 1976 [JP] Japan ..... 51/37745

[51] Int. Cl.[2] ..... G03G 5/05

[52] U.S. Cl. ..... 96/1.5 R; 96/1.8; 428/414; 428/416

[58] Field of Search ..... 96/1.5, 1.8; 428/414, 428/416

[56] References Cited

U.S. PATENT DOCUMENTS

| | | | |
|---|---|---|---|
| 3,241,958 | 3/1966 | Bornarth et al. | 96/1.8 |
| 3,639,121 | 2/1972 | York | 96/1.5 |
| 3,723,110 | 3/1973 | Goffe | 96/1.8 X |
| 3,740,219 | 6/1973 | Kosche | 96/1.5 X |
| 3,775,108 | 11/1973 | Arai et al. | 96/1.8 |
| 3,778,264 | 12/1973 | Arai et al. | 96/1.5 X |
| 3,950,169 | 4/1976 | Timmerman et al. | 96/1.5 |

FOREIGN PATENT DOCUMENTS

| | | | |
|---|---|---|---|
| 1102348 | 2/1968 | United Kingdom | 96/1.8 |

*Primary Examiner*—Roland E. Martin, Jr.
*Attorney, Agent, or Firm*—James E. Nilles

[57] ABSTRACT

An electrophotographic photosensitive material comprising a substrate, a photoconductive photosensitive layer, and an intermediate layer interposed between the substrate and the photosensitive layer, said intermediate layer containing a compound which has at least one of hydroxyl and amino groups together with a quaternary ammonium group. The substrate includes a metallic support body and a conductive protection layer applied to form a surface layer on said metallic support body and made of a resin dispersed with carbon particles.

6 Claims, No Drawings

ELECTROPHOTOGRAPHIC MATERIAL WITH INTERMEDIATE LAYER

The present invention relates to an electrophotographic photosensitive material, and particularly to an electrophotographic photosensitive material having an intermediate layer interposed between a substrate and a photosensitive layer.

It has conventionally known to the art of electrophotographic photosensitive material such the material that has an intermediate layer interposed between a conductive substrate and a photoconductive photosensitive layer. This intermediate layer exerts considerable effects on the electrophotographic image formation properties of the electrophotographic photosensitive material, such as the charging property of photosensitive layer, the dark decay property, the value of residual potential, the sensitivity or the like, and thus exercises great influences upon the tone and quality of the electrophotographically formed image. It also exerts considerable influences on the physical properties of the apparatus, such as the abrasion resistance property, resistance against corona discharge, humidity proof property or the like thereof, when it is used in an electrophotographic copying apparatus of repeated transfer type.

Such the intermediate layer is required to be sufficiently adhesive to the upper and lower layers thereof and to have an adequate conductivity. The conventionally known intermediate layers contain materials for improving the formed electrophotographic images, such as casein, polyvinyl alcohol, carboxymethyl cellulose, ethyl cellulose or vinyl acetate, and solid materials for improving conductivities and adhesivenesses thereof, such as powdered silica or clay, dispersed in the intermediate layer. The intermediate layer containing a compound having a quaternary ammonium group has also been well known to the prior art. Such the intermediate layer has an advantageous conductivity, and an electrophotographic photosensitive material combined with such the intermediate layer has advantages that is forms reproduced images of superior quality without fog since the electric and physical properties thereof are not changed even in a dry atmosphere, and that the photosensitive layer is not easily fatigued to cause deterioration in quality of the formed images if it is used in an electrophotographic copying machine of repeated transfer type. Further, the intermediate layer is not deteriorated by a thermal treatment which is normally required to form a photosensitive layer containing a thermosetting resin as a binder resin.

However, the conventionally known intermediate layer has disadvantages such that the inherent mechanical strengthes thereof, particularly the abrasion resistance property, are inferior. Due to the above mentioned disadvantage, serious problems arise when an electrophotographic material is produced by applying another superimposed layer for forming an upper layer on the intermediate layer. In general, such upper layer is formed by the steps of coating a liquid material on the layer and drying the thus obtained coating layer, and most preferably the aforementioned coating is carried out by means of a wire bar coater. However, during the operation of coating the liquid material by means of the wire bar coater on said intermediate layer, the pointed ends of the wire members of the wire bar coater move in contact with the surface of the intermediate layer thereby to form scratch scars on the surface. As a result, the property of the photosensitive layer which is the upper layer is deteriorated to cause fog in the formed electrophotographic image thereby to deteriorate the quality of the image.

The mechanical strength of the electrophotographic photosensitive material is consequently lowered due to poor mechanical strength of the intermediate layer so as to shorten the life time thereof when it is used in an electrophotographic copying maching of repeated transfer type.

Further disadvantage of the conventionally known intermediate layer is that is has not sufficient adhesive property for securing perfect adhesion with the substrate and the upper layer such as the photosensitive layer to be integrally bound therewith, so that the intermediate layer tends to peel off during manufacture of the electrophotographic photosensitive material. The formed electrophotographic photosensitive material is disadvantageous in that the charge accepting property thereof is inferior or the residual potential thereof becomes high, so that it is impossible to provide sufficient density of the formed electrophotographic image. Another disadvantage thereof is poor durability.

It is, therefore, the object of the present invention to provide an electrophotographic photosensitive material including an intermediate layer which has high mechanical strength, particularly good abrasion resistance property, and which has no scars on the surface thereof even if it is superimposed with an upper layer formed by means of a wire bar coater.

Further object of the present invention is to provide an electrophotographic photosensitive material having superior electrical properties and satisfactory durability and including an intermediate layer which has sufficient adhesive property enough to easily and surely unify with the substrate or another layer.

Yet a further object of the present invention is to provide an electrophotographic photosensitive material including an intermediate layer which is sufficiently stiff and thus durable with this regard, and has superior humidity proof property and yet has an adequate flexibility.

Another object of the present invention is to provide an electrophotographic photosensitive material for forming good electrophotographic images and including an intermediate layer which has improved mechanical strengthes and which exerts preferable effects on the image forming property of the material.

In order to attain the above mentioned objects, an intermediate layer containing an epoxy resin and a compound having one or both of hydroxyl group and amino group together with a quaternary ammonium group (hereinafter referred to as "Compound A") is interposed between the substrate and the photosensitive layer.

More specifically, the electrophotographic photosensitive material according to the present invention may be produced by the steps of mixing and dispersing the Compound A, an epoxy resin and other resins, if desired, into a proper solvent; coating the thus obtained dispersion onto the surface of a substrate, e.g. the surface of a conductive substrate; drying the coated dispersion; and curing the coated layer by subjecting it to thermal treatment, if desired, thereby to form an intermediate layer. A photosensitive layer is then formed on the intermediate layer.

Various kinds of photosensitive layers may be used in the present invention. However, preferably photosensitive layers are those obtained by dispersing photoconductive materials in binder resins. Examples of usable photoconductive materials are cadmium sulfide (CdS), cadmium sulfide selenide (CdSSe), cadmium selenide (CdSe), zinc selenide (ZnSe), zinc oxide (ZnO), titanium dioxide ($TiO_2$) or other compounds. Examples of binder resins are thermosetting resins such as alkyd resins, epoxy resins, acrylic resins, melamine resins, phenolic resins, and/or thermoplastic resins such as polymers of vinyl acetate, methyl metacrylate, methyl acrylate or the like. The thickness of the photosensitive layer is normally in the range of 5 to 100 $\mu$, and preferably in the range of 10 to 50 $\mu$.

Many advantageous effects may be obtained from the electrophotographic photosensitive material of the present invention which includes the above mentioned intermediate layer. The epoxy resin contained in the intermediate layer reacts with the hydroxyl and/or amino groups of said Compound A to be mutually crosslinked and to form a network structure during its setting process, whereby the intermediate layer becomes to have sufficient rigidity, superior mechanical strength, particularly good abrasion resistance property. The surface of the thus obtained intermediate layer is hardly to be scratched during the coating of a photosensitive dispersion for forming a photosensitive layer or any other layer forming liquids. It is, therefore, possible to produce an electrophotographic photosensitive material easily and effectively by carrying out said coating operation by means of a wire bar coater without any special care. Moreover, the thus obtained electrophotographic photosensitive material is advantageous in that it does not form irregular electrophotographic images caused by scars on the surface of the intermediate layer. Furthermore, the photosensitive material has a prolonged life time when used in an electrophotographic copying machine of repeated transfer type, since the mechanical strengthes of the intermediate layer thereof are high.

Yet a further advantage is that the photosensitive layer is neither deformed nor deteriorated in its properties due to by-product water, since the epoxy resin polymerizes by addition polymerization reaction in which water or any other reaction products is not formed so that reduction in volume is not resulted, otherwise resulted in cases where resins setting by condensation polymerization are used. Further, epoxy groups have special affinity to amino groups to react with them at low temperature. For this reason, high temperature thermal treatment is not required and various bad effects caused by high temperature treatment are avoided.

Since the intermediate layer according to the present invention is highly adhesive due to the fact that it contains an epoxy resin, it will unify with the substrate and another layer at sufficient extent so as to be freed from irregularlity in property due to imperfect unification, thereby to strengthen the entire construction and improve durability of the photosensitive material.

Moreover, in the intermediate layer of the invention, not only the water proof property but also the electrical durability may be improved by the existing crosslinked structure of the epoxy resin, which effectively prevent formation of white patches on the electrophotographic images due to electric breakdown.

Since said intermediate layer contains the Compound A having therein a quaternary ammonium group, electrophotographic images of superior quality may be obtained. By way of example, it may be mentioned the facts that images without fog may be obtained even in a dry atmosphere since the electrical and physical properties of the photosensitive material will not change under such the environmental conditions, and that the material is hardly to be fatigued or deteriorated since it has an improved durability.

In a further embodiment of the present invention, a compound having therein an isocyanate group (hereinafter referred to as "Compound B") is included in the intermediate layer in addition to said epoxy resin and Compound A. In such the intermediate layer, the isocyanate group in the Compound B will also combine with the epoxy resin to form a photosensitive material which has an adequate flexibility. Inclusion of the isocyanate group is preferred particularly in case where the content of the epoxy resin in the intermediate layer is increased for preventing fragility of the layer otherwise caused by increase in content of the epoxy resin.

The mixing ratios of epoxy resin relative to the Compound A and the Compound B may be determined such that the number of the epoxy groups in the epoxy resin is equivalent to the total number of the functional groups of the Compound A and the Compound B, i.e. the total number of hydroxyl, amino and isocyanate groups. However, it is not required that all of the above mentioned functional groups react with the epoxy groups. It is also unnecessary that all of the epoxy groups react with said functional groups. Therefore, the ratios between them may be determined in consideration of the desired property of the resultant intermediate layer. It should be appreciated that any other materials may be contained in the intermediate layer according to the present invention as far as the advantageous effect of the invention is not brought to naught.

The materials which may be used in the present invention will now be specifically described.

Various epoxy resins may be used in the present invention. Among them, typical structural formula of the epoxy resin is shown below. Many epoxy resins of various types may be used irrespective of whether they are liquid at room temperature or not and regardless of their molecular weights (normally the molecular weight ranges from 300 to 200,000).

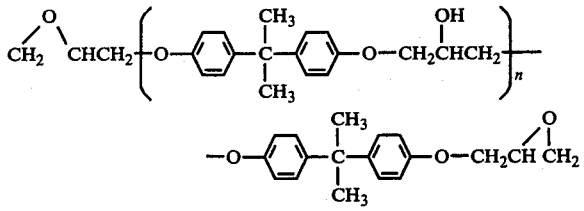

Representative examples of the Compound A are set forth below. In the following formulae, $n_1$, $n_2$ and $n_3$ show, respectively, the polymerization mol % of each of the monomers.

A-1)

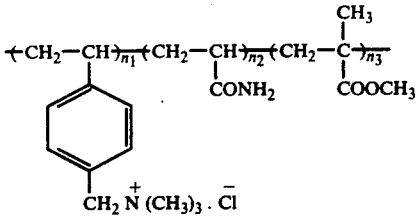

$n_1 : n_2 : n_3 = 30 : 10 : 60$

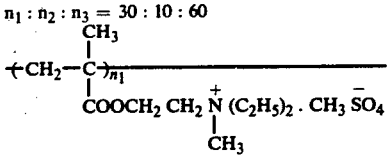

A-2)

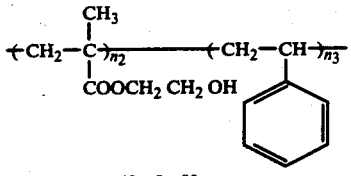

$n_1 : n_2 : n_3 = 40 : 5 : 55$

A-3)

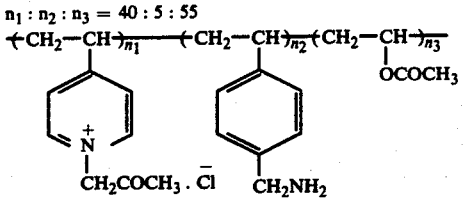

$n_1 : n_2 : n_3 = 10 : 30 : 60$

A-4)

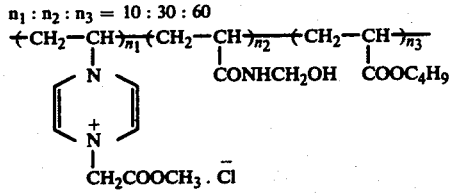

$n_1 : n_2 : n_3 = 25 : 1 : 74$

A-5)

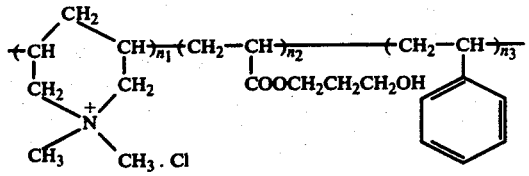

$n_1 : n_2 : n_3 = 35 : 10 : 55$

A-6)

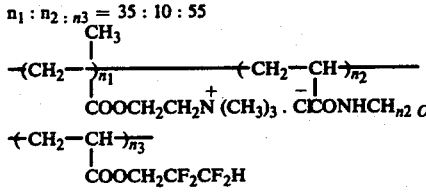

$n_1 : n_2 : n_3 = 40 : 0.5 : 59.5$

A-7)

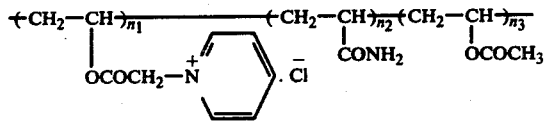

$n_1 : n_2 : n_3 = 30 : 1 : 69$

A-8)

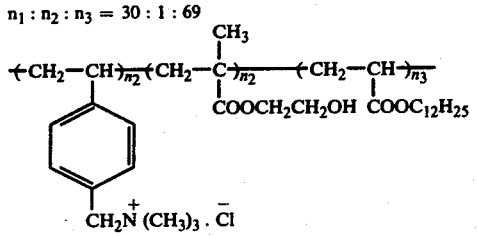

$n_1 : n_2 : n_3 = 10 : 5 : 85$

A-9)

-continued

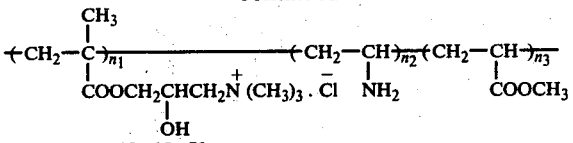

$n_1 : n_2 : n_3 = 15 : 15 : 70$

A-10)

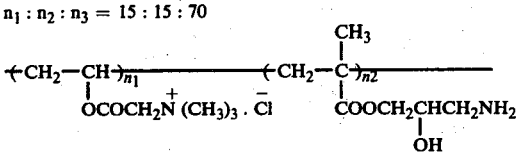

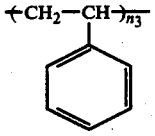

$n_1 : n_2 : n_3 = 30 : 10 : 60$

A-11)

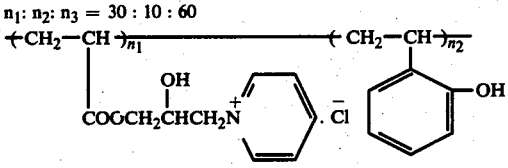

$n_1 : n_2 = 50 : 50$

A-12)

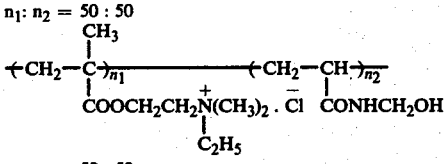

$n_1 : n_2 = 50 : 50$

A-13)

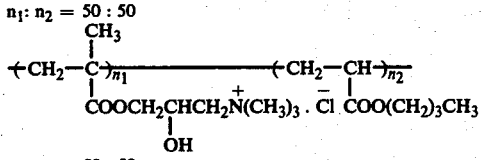

$n_1 : n_2 = 50 : 50$

A-14)

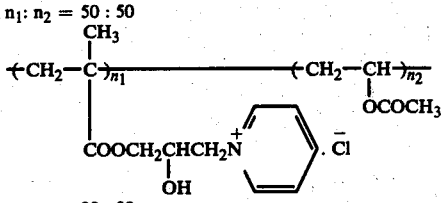

$n_1 : n_2 = 20 : 80$

Other commercially available cation conductive agents containing therein quarternary ammonium groups and being usable as the Compound A include "Elecond B-146", "Elecond B-134D" and "Elecond B-144L".

Representative Examples of the Compound B are set forth below.

B-1)

Diphenylmethane-p,p'-diisocyanate

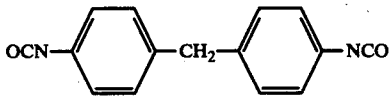

B-2)

Polyisocyanate which is a polymer of 1).

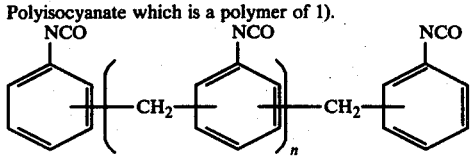

B-3)

Reaction product of toluidine diisocyanate and trimethyol propane.

-continued

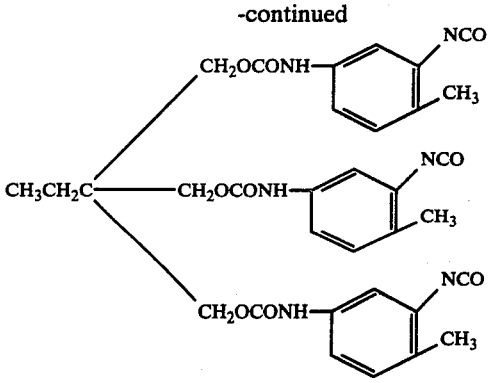

Tolylene diisocyanate

Mixture of

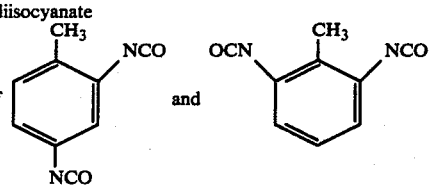

and 3,3'-dimethyl-diphenyl 4,4'-diisocyanate

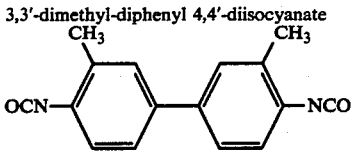

3,3'-dimethyl-diphenylmethane 4,4'-diisocyanate

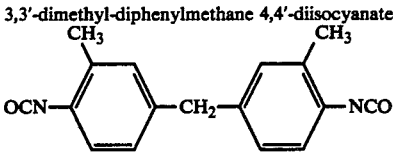

Metaphenylene diisocyanate

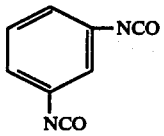

Triphenylmethane-triisocyanate

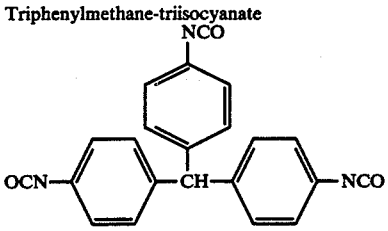

2,4'-tolylene-diisocyanate

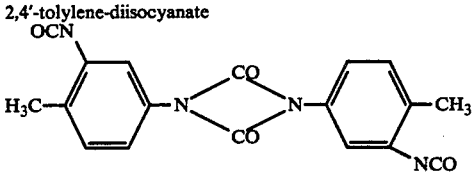

Hexamethylene diisocyanate
$NCO(CH_2)_6OCN$

Naphtylene-1,5-diisocyanate

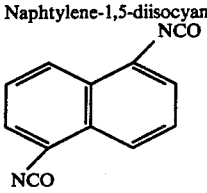

-continued 1-isocyanate-6-N,N-dicarboxyhexamethylene-isocyanate-n-hexane

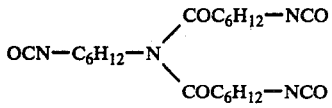

In general, a metal plate, such as an aluminum plate or stainless steel plate, may be used as the conductive substrate for supporting the aforementioned intermediate and photosensitive layers, since the metal plate has sufficient mechanical strength, and is easily to be formed to have a drum shape and can establish perfect connection with earth.

However, if said intermediate layer containing therein the Compound A having a quaternary ammonium group is directly applied on a metallic substrate, the latter is disadvantageously corroded by the chemical action of said Compound A. When corrosion occurs, blisters, cracks or other defects are formed in the intermediate and photosensitive layers, so that the thunderbolt phenomenon is occurred in the charging step, i.e. the corona discharge step for forming electrostatic latent images on the photosensitive layer, of the electrophotographic process, or the development bias potential drops in the development step, i.e. the step for forming toner images; and as a result, the resultant material becomes practically unsuited for use as an electrophotographic photosensitive material. Such the corrosion is caused by the fact that the intermediate layer tends to contain water due to the hygroscopic property of the Compound A to cause rusts in the metal by the action of water, and that the Compound A reacts with water to form hydrochloric acid or sulfuric acid which in turn dissolves metal when the Compound A of the form of chloride or methosulfate is used as frequently the case may be.

It is, therefore, preferred to use a substrate which is not corroded even when the intermediate layer of the present invention is directly applied thereon and which does not exert any disadvantageous effects on the intermediate layer, and which has superior properties to give an electrophotographic photosensitive material for forming thereon good images.

In accordance with the present invention, a conductive protection layer essentially consisting of a resin dispersed therein with carbon particles (carbon black) is disposed on a metallic support body to form a substrate on which the intermediate and photosensitive layers are applied. In the course of making such the substrate, conductive carbon powders are dispersed in a mixture of a thermosetting resin and a dispersing agent by means of a ball mill or supersonic dispersion method, and the thus obtained dispersion liquid is coated on the surface of a support body comprising, for example, an aluminum or stainless steel plate or sheet of about 100 $\mu$ in thickness, and the coating layer is then dried and allowed to set to form a conductive protection layer.

The above mentioned substrate has a conductive protection layer which is composed of a resinous material dispersed therein with carbon particles and chemically inactive and thus is not affected by the chemical action of the Compound A having therein quarternary ammonium group. For this reason, the support body is not corroded even if an intermediate layer is applied on said protection layer. Since the above mentioned protection layer is conductive due to the dispersed carbon particles, the electrophotographic photosensitive material of the present invention including said substrate allows the composite layers, particularly the intermediate layer, to exert their full functions and characteristic features without any accompanying disadvantages. Particularly, fear for occurrences of thunderbolt phenomenon in the charging step and of bias potential drop in the development step can be completely eliminated so as to make it possible to form electrophotographic images of superior quality.

Any of the thermoplastic and thermosetting resins which can form films and have adhesive properties may be used in said protection layer. For example, epoxy resins, polyvinyl acetate resin, polyvinyl chloride resin, acrylic ester resins, alkyd resins, melamine resins and other resins may be used singly or in combination. However, resins which have good affinities to the resin used in the intermediate layer which will be applied on the protection layer shall be used. Epoxy resins are particularly suited for use in the protection layer, since they have satisfactory adhesive properties both to the intermediate layer containing an epoxy resin and to the support body.

The carbon particles produced by any of the oil-furnace method, gas-furnace method, channel method, thermal method, acetylene black method, and carbon particles having large structure, small granular sizes and high conductivity are preferred. The ratio of carbon particles relative to said resin may be determined depending on the property of the used carbon particles, and may be varied over a wide range since the electric resistance of the carbon particles is very low. In practice, the amount of the carbon particles is determined in consideration of the adhesion between the intermediate layer and the substrate and of the electric properties thereof. The ratio of carbon relative to the resin ranges generally from 10 to 80% by weight, preferably from 20 to 50% by weight, for example, from 2 to 10 g of carbon is mixed with 20 g of a solid resin. If the amount of carbon is too small, the conductivity of the protection layer is lowered; and the result is that in the resultant photosensitive material high residual potential remains in the irradiated areas of the photosensitive layer due to insufficient dissipation of charges in the irradiated areas even after the photosensitive layer, which is firstly subjected to corona discharge operation to be charged, is then subjected to imagewise irradiation, which in turn causes fogs in the developed images when the electrostatic latent images are developed with a powder developer. On the other hand, if the amount of carbon is excessive, adhesion to the support body and the intermediate layer is badly affected so as to make it impossible to produce an electrophotographic photosensitive material having sufficient mechanical strengthes. The thickness of the protection layer may be varied as desired, and generally ranges from 2 to 300 microns.

As is described hereinbefore, the substrate provided with an inactive protection layer is not affected by the disadvantageous chemical action of the materials contained in the intermediate layer. Accordingly, a metallic support body may be used without any accompanying disadvantages to make full use of its preferable properties. It should be appreciated that the effects of the protection layer is not limited only when a metal plate is used as the support body, but the similar effects can be obtained when a support body made of, for instance, a suitable substrate having thereon a metal coating or a material composed of a resin and dispersed metal powders.

The present invention will now be described in detail with reference to the examples thereof.

EXAMPLE 1

| | | |
|---|---|---|
| Cadmium sulfide crystallite (average granular size : 1μ) | 10.0 | g |
| Thermosetting acrylic resin | 6.0 | g |
| Butylated melamine resin | 0.8 | g |
| Epoxy resin | 0.8 | g |
| Fluorine compound | 0.08 | g |
| Butyl acetate | 7 | ml |

The starting materials set forth above were mixed together and dispersed by means of supersonic dispersion to obtain a photosensitive liquid. The photosensitive liquid was coated on the surface of a provisional substrate of polyethylene terephthalate film of 100 μ thickness to obtain a dried coating of 25 μ thickness by means of a wire bar coater and dried. The coating layer was then subjected to a heat treatment at 130° C for 30 minutes to form a photosensitive layer.

| | | |
|---|---|---|
| Epoxy resin | 10 | g |
| Compound A (Representative Example A-3) | 100 | g |
| Compound B (Representative Example B-3) | 10 | g |

A mixture of the above three components was dissolved in a mixed solvent consisting of methylethyl ketone and methyl alcohol in a ratio of 7 : 3 to obtain a 10% by weight solution which was used as the intermediate layer forming solution, and coated and dried on the surface of said photosensitive layer to obtain a layer of 5 μ in thickness. The layer was further subjected to a heat treatment at 100° C for 1 hour to form an intermediate layer.

| | | |
|---|---|---|
| Conductive carbon | 7.0 | g |
| Thermosetting acrylic resin | 40 | g |
| Toluene | 150 | ml |

A mixture of the above three components was dispersed sufficiently in a ball mill to obtain a dispersion which was then coated and dried on the surface of said intermediate layer by the use of a wire bar coater. The resultant layer was subjected to a heat treatment at 130° C for 1 hour to obtain a conductive layer of 50 μ in thickness. An intermediate photosensitive material had thus been prepared.

A permanent substrate of a composite film composed of laminated films of polyester of 50 μ in thickness and of polyethylene of 50 μ in thickness was laminated on the surface of said photoconductive layer, and thereafter said provisional substrate was peeled off to allow the surface of the photosensitive layer to be exposed. An electrophotographic photosensitive material having flat surface had thus been prepared, which will be referred to as Sample 1 hereinafter.

EXAMPLE 2

| | | |
|---|---|---|
| Epoxy resin | 10 | g |
| Compound A (Representative Example A-12) | 100 | g |
| Compound B (Representative | | |

-continued

| | |
|---|---|
| Example B-8) | 10 g |

An intermediate layer forming liquid was prepared using a mixture of the above three components in a similar manner as in Example 1. An electrophotographic photosensitive material was prepared in the same manner as in Example 1 except in that the above noted intermediate layer forming liquid was used in place of the liquid described in Example 1. The thus prepared material will be referred to as Sample 2 hereinafter.

EXAMPLE 3

| | |
|---|---|
| Epoxy resin | 10 g |
| Compound A (Elecond B-146) | 100 g |
| Compound B (Representative Example B-9) | 10 g |

An intermediate layer forming liquid was prepared using a mixture of the above three components in a similar manner as in Example 1. An electrophotographic photosensitive material was prepared in the same manner as in Example 1 except in that the above noted intermediate layer forming liquid was used. The thus prepared material will be referred to as Sample 3 hereinafter.

EXAMPLE 4

| | |
|---|---|
| Epoxy resin | 10 g |
| Compound A (Representative Example A-7) | 100 g |

A mixture of the above two components was dissolved in a mixed solvent consisting of methylethyl ketone and methyl alcohol in a ratio of 8 : 2 to obtain a 10% by weight solution which was used as the intermediate layer forming liquid. Other procedures for preparing an electrophotographic photosensitive material were same as in Example 1. The thus prepared material will be referred to as Sample 4 hereinafter.

Samples 1 to 4 were put to successive reproduction tests while attaching them to an electrophotographic copying machine of repeated transfer type. The results were that all of them could reproduce electrophotographic images of good quality even after 7,000 copies had been reproduced by them.

On the other hand, four Control Samples of electrophotographic photosensitive materials respectively corresponding to said Samples 1 to 4 were prepared in similar manners as in Examples 1 to 4 except in that a thermosetting acrylic resin was used in each of the intermediate layer forming liquids in place of the epoxy resin used in Examples 1 to 4. These Control Samples were put to successive reproduction tests in the same manner as described above. The results were that the every first copy obtained by any of them gave an electrophotographic image containing linear lines which had no connection with the original image. Such the linear line images became gradually deeper and thicker as the copying operations were repeated. This is considered to be caused by the fact that the electric potential characteristic of the photosensitive layer is changed by scratched scars which are formed on the surface of the intermediate layer by the wire bar coater in the step of coating the conductive layer forming liquid on the intermediate layer for preparing the electrophotographic photosensitive material.

EXAMPLE 5

| | |
|---|---|
| Conductive carbon black | 6 g |
| Alkyd resin | 40 g |
| Butyl acetate | 150 ml |

A mixture of the above components was put into a ball mill for perfect dispersion. The thus obtained dispersion liquid was then coated on a stainless steel sheet of 100 μ in thickness by a dipping method and dried to obtain a dried coating of 13 μ in thickness. The coating was subjected to a heat treatment at 130° C for 1 hour to form a protection layer, whereupon a substrate was prepared.

| | |
|---|---|
| Epoxy resin | 7 g |
| Compound A (Representative Example A-3) | 100 g |
| Compound B (Representative Example B-3) | 10 g |

The above three components were mixed together, and the mixture was dissolved in a mixed solvent consisting of methylethyl ketone and methyl alcohol in a ratio of 7 : 3 to obtain a 10% by weight solution. The solution was coated on said substrate and dried to obtain a layer of 5 μ in thickness. The layer was then subjected to a heat treatment at 90° C for 1 hour to form an intermediate layer on said substrate. An electrophotographic photosensitive layer was formed by coating the same photosensitive liquid as used in Example 1 on the surface of said intermediate layer by means of a wire bar coater to obtain a coating of 25 μ thickness. The coating was dried and subjected to a heat treatment at 130° C for 30 minutes to obtain an electrophotographic photosensitive material. The thus prepared material will be referred to as Sample 5 hereinafter.

The epoxy resin used in this Example was basically represented by the following structural formula:

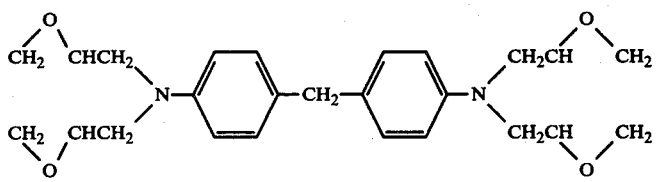

EXAMPLE 6

| | |
|---|---|
| Epoxy resin | 10 g |
| Compound A (Representative Example A-3) | 100 g |

The above two components were mixed together, and the mixture was dissolved in a mixed solvent consisting of methylethyl ketone and methyl alcohol in a ratio of 1 : 1 to obtain a 10% by weight solution. An electrophotographic photosensitive material was prepared in similar manner as in Example 5 except that the intermediate layer was formed using the solution described immediately before. The thus prepared material will be hereinafter referred to as Sample 6.

On the other hand, two electrophotographic photosensitive materials respectively corresponding to said Samples 5 and 6 were prepared in similar manners as in Examples 5 and 6 except in that an alkyd resin were used in each of the intermediate layer forming liquids in place of the epoxy resin used in Examples 5 and 6. The thus prepared materials will be hereinafter referred to as Control Samples 5 and 6, respectively.

Samples 5 and 6 and control Samples 5 and 6 were put to successive reproduction tests by attaching them to the same electrophotographic copying machine of repeated transfer type. The tests were conducted in an atmosphere where the temperature was maintained at 30° C and the relative humidity was 80%. The test results revealed that Sample 5 gave images of good quality even after 25,000 copies had been reproduced, and that Sample 6 gave images of good quality even after 22,000 copies had been reproduced. On the contrary, with the use of Control Sample 5, conspicuous linear patterns and white patches were observed after about 1,000 copies had been reproduced, and the images, which were obtained after 12,000 copies had been reproduced, were not usable as electrophotographies. Similar defects were observed in the images obtained by using Control Sample 6 as was the case of Control Sample 5. Available number of copies were only about 10,000 sheets.

The linear patterns appearing in the images obtained by the use of Control Samples were estimated from their features to be those caused by scars formed on the surfaces of the intermediate layers by the wire bar coaters in the processes of coating the photosensitive liquid. The white patches seemed to be resulted from unevenness of electrical properties due to insufficient adhesion between the intermediate layer and the substrate or to be caused by deterioration of electrical properties due to humidity.

It should be understood from Examples 1 to 3 and 5 that the intermediate layer of the present invention preferably includes the Compound B in addition to an epoxy resin and the Compound A. However, it should be noted from Examples 4 and 6 that the aimed functional effect can be attained even if the intermediate layer which does not include the Compound B is used.

EXAMPLE 7

The same substrate as described in Example 5 was used. On the substrate coated was the intermediate layer forming liquid which had been used in Example 3. The coating layer was dried to obtain an intermediate layer of 5 μ in thickness. On the thus formed intermediate layer coated was the same photosensitive liquid as used in Example 1 by means of a wire bar coater. The coating liquid was dried to obtain a dried coating layer of 25 μ in thickness and the layer was then subjected to a heat treatment at 150° C for 30 minutes to obtain a sample photosensitive material.

A control sample of photosensitive material was prepared following to the general procedures set forth immediately before except in that a stainless steel sheet which was not provided with the protection layer was used as the substrate and that the intermediate layer was directly applied on the stainless steel sheet.

After storing both of the above sample and control sample for 1 month, surfaces of these photosensitive layers were inspected. The results were that blisters, which seemed to be caused by corrosion of the stainless steel sheet, were observed on the surface of the control sample, whereas no substantial change was observed on the surface of the sample.

These samples were also put to successive reproduction tests wherein respective samples were attached to an electrophotographic copying machine of repeated transfer type including a magnetic brush developer means and 20 sheets per minute of copies were reproduced. As a result, a clear picture image of high contrast which was equivalent to those obtained in the initial stage was obtained as the 5,000th copy, when the sample photosensitive material was used. On the contrary, a thunderbolt phenomenon occurred in the charging step to make it impossible to continue copying operation after about 120 copies had been reproduced, when the control sample was attached to the same copying machine.

EXAMPLE 8

| | |
|---|---|
| Carbon powder | 9 g |
| Thermosetting acrylic resin | 40 g |
| Butyl acetate | 150 ml |

The above noted starting materials were mixed together, and the solid components were sufficiently dispersed using a ball mill. The resultant dispersion liquid was coated on an aluminum plate of 200 μ thickness by means of a wire bar coater, and dried to obtain a coating of 15 μ in thickness. The coating was subjected to a heat treatment at 150° C for 30 minutes to form a protection layer, whereupon a substrate was prepared.

On the other hand, an intermediate layer forming liquid was prepared using the following three components.

| | |
|---|---|
| Epoxy resin | 10 g |
| Compound A (Representative Example A-13) | 100 g |
| Compound B (Representative Example B-8) | 10 g |

The thus obtained intermediate layer forming liquid was coated on the protection layer by dipping method and dried to form an intermediate layer of 5 μ in thickness.

| | |
|---|---|
| Highly sensitive crystallite of CdS (average granular size : 1 μ) | 10 g |
| Alkyd resin | 6 g |
| Melamine resin | 1 g |
| Cobalt naphthenate | 0.3 g |
| Butyl acetate | 7 ml |

A mixture of the above components was dispersed by means of a supersonic dispersion to obtain a photosensitive liquid, which was then coated on said intermediate layer by the use of a wire bar coater and dried to obtain a coating layer of 20 μ in thickness. The coating layer was then subjected to a heat treatment at 120° C for 1 hour to obtain a sample photosensitive material.

A control sample was prepared in the same manner as described immediately before except in that an aluminum plate which was not provided with said protection layer was used as the substrate and that the intermediate layer was applied directly on the aluminum plate.

After storing both of the above sample and control sample for 2 weeks, surfaces of these photosensitive layers were inspected. The results were that several blisters, which seemed to be caused by corrosion of the aluminum plate due to the chemical action of the intermediate layer, were observed on the surface of the control samples, whereas no substantial change was observed on the sample.

These samples were further put to successive reproduction tests following to the procedures same as in Example 7. The results revealed that a clear picture image of high contrast which was equivalent to those obtained in the initial stage was obtained as the 5,000th copy, when the sample photosensitive material was used. On the contrary, a thunderbolt phenomenon occurred in the charging step to make it impossible to continue copying operation after about 300 to 400 copies had been reproduced, when the control samples was used.

EXAMPLE 9

| | |
|---|---|
| Conductive carbon black | 5 g |
| Water soluble alkyd resin (non-volatile fraction : 50%) | 40 g |
| Water soluble melamine resin | 5 g |
| Water | 200 ml |
| Isopropyl alcohol | 100 ml |

The above starting materials were mixed together and perfectly dispersed in a ball mill to obtain a dispersion liquid. On the other hand, a stainless steel sheet of 100 $\mu$ in thickness and 50 mm $\times$ 150 mm in dimensions was sufficiently rinsed with a mixed liquid composed of equivalent volumes of ethyl alcohol and benzene. Said dispersion liquid was coated on the rinsed stainless steel sheet by means of electrophoresis. In detail, the electrophoresis coating was applied in such the manner that the distance between the positive electrode of said stainless steel and the negative eletrode of another stainless steel sheet of same shape and dimensions was maintained at the distance of 7 cm, and that a direct current source which could supply maximum output current of 100 mA within a voltage range of 0 to 500 V was used to supply electric current of 50 V between the electrodes for 2 minutes while agitating with a magnetic stirrer thereby for forming a black coating film on the positive electrode of stainless steel sheet. The coating film was washed with water and then subjected to a heat treatment at 150° C for 1 hour to form a protection layer of about 20 $\mu$ in thickness, whereupon a substrate was prepared.

On the other hand, an intermediate layer forming liquid was prepared using the following two components.

| | |
|---|---|
| Epoxy resin | 10 g |
| Compound A (Representative Example A-14) | 100 g |

The thus obtained intermediate layer forming liquid was coated on the protection layer of said substrate and dried to form an intermediate layer of about 5 82 in thickness.

| | |
|---|---|
| Highly sensitive crystallite of CdS (average granular size : 1 $\mu$) | 10 g |
| Thermosetting acrylic resin | 6 g |
| Melamine resin | 1 g |
| Epoxy resin | 0.5 g |
| Fluorine surface active agent | 0.07 g |

A mixture of the above components was dispersed by means of supersonic wave to obtain a photosensitive liquid, which was then coated by a wire bar coater and dried to obtain a coating of 25 $\mu$ thickness. The coating was then subjected to a heat treatment at 150° C for 30 minutes to obtain a sample photosensitive material.

On the other hand, a control sample was prepared in the same manner as described immediately before except in that said stainless steel plate which was not provided with said protection layer was used as the substrate and that the intermediate layer was directly applied thereon.

After storing both of the above sample and control sample for 3 weeks, surfaces of these photosensitive layers were ispected. The results were that blisters, which seemed to be caused by corrosion of the stainless steel sheet due to the chemical action of the intermediate layer, were observed on the surface of the control sample, whereas no substantial change was observed on the surface of the sample.

These samples were further put to successive reproduction tests in the same manner as in Example 7. The results revealed that a clear picture image of high contrast which was equivalent to those obtained in the initial stage was obtained as the 7,000th copy, when the sample photosensitive material was used. On the contrary, a thunderbolt phenomenon occurred in the charging step to make it impossible to continue copying operation after about 300 to 400 copies had been reproduced, when the control sample was used.

As will be clearly understood from Examples 7 to 9, by using a substrate having a protection layer disposed on a metallic support body and essentially consisting of a resin and carbon particles dispersed therein, the resultant electrophotographic photosensitive material can be stored for prolonged period of time for ready to use even if an intermediate layer containing the Compound A having therein quarternary ammonium group is directly applied on the substrate.

As described in detail hereinbefore, the electrophotographic photosensitive material of the present invention has various advantages such that the mechanical strengthes, particularly the abrasion resistance property, of the intermediate layer can be considerably improved, and that the adhesive property of the intermediate layer may be improved at a sufficient extent. Electrophotographic images of superior quality may be obtainable by the use of the material according to the present invention which is particularly suited for use in an electrophotographic copying machine of repeated transfer type. Further, the metallic support body provided with the protection layer provides sufficient mechanical strengthes, easiness for forming a drum, easiness for establishing connection with ground. The protection layer of the invention does not exert any bad influence on the intermediate and photosensitive layers so as to allow them to exhibit their functions and effects sufficiently. The electrophotographic photosensitive material of the present invention is advantageous in that it gives reproduced images of superior quality even after it is stored for prolonged period of time.

What is claimed is:

1. An electrophotographic photosensitive material comprising:

(a) a substrate;

(b) a protective conductive layer disposed upon said substrate, said layer being comprised of a resin having carbon particles dispersed therein;

(c) an intermediate layer disposed upon said protective conductive layer, which intermediate layer includes the cross-linked product of an epoxy resin having at least two epoxy groups and a cation conductive agent selected from the group consisting of the compounds represented by the following structural formulae:

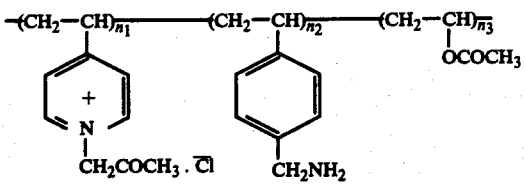

(a)

$n_1 : n_2 : n_3 = 10 : 30 : 60$

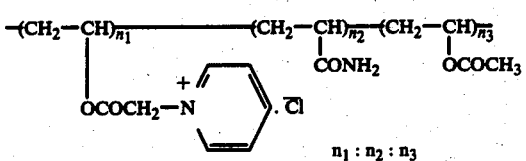

(b)

$n_1 : n_2 : n_3 = 30 : 1 : 69$

-continued

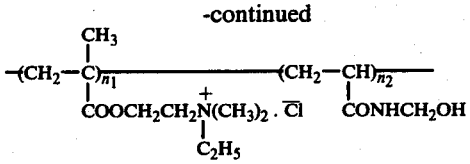

(c)

$n_1 : n_2 = 50 : 50$; and

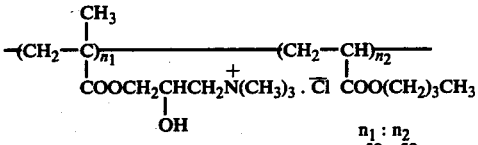

(d)

$n_1 : n_2 = 50 : 50$

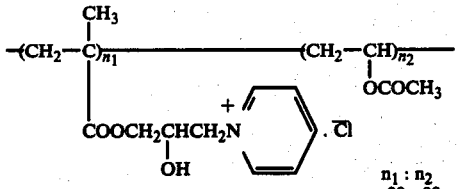

(e)

$n_1 : n_2 = 20 : 80$ wherein $n_1$, $n_2$ and $n_3$ show, respectively, the polymerization mol % of each of the component monomers; and (d) a photosensitive layer disposed upon said intermediate layer.

2. An electrophotographic photosensitive material according to claim 1, wherein said intermediate layer further contains an isocyanate compound.

3. An electrophotographic photosensitive material according to claim 1, wherein the epoxy resin has a molecular weight of about 300 to about 200,000.

4. An electrophotographic photosensitive material according to claim 1, wherein the resin of the protective conductive layer is an epoxy resin.

5. An electrophotographic photosensitive material according to claim 1, wherein the protective conductive layer contains 10 to 80% by weight of carbon particles based on the weight of the resin.

6. An electrophotographic photosensitive material according to claim 1, wherein the substrate is a metal sheet.

* * * * *